US007193402B2

(12) United States Patent
Lee et al.

(10) Patent No.: US 7,193,402 B2
(45) Date of Patent: Mar. 20, 2007

(54) BANDGAP REFERENCE VOLTAGE CIRCUIT

(75) Inventors: Jian-Lung Lee, Yilan (TW); Tsung-Hsiu Wu, Tainan (TW)

(73) Assignee: Analog Integrations Corporation, Hsinchu (TW)

( * ) Notice: Subject to any disclaimer, the term of this patent is extended or adjusted under 35 U.S.C. 154(b) by 50 days.

(21) Appl. No.: 11/202,967

(22) Filed: Aug. 12, 2005

(65) Prior Publication Data

US 2007/0035286 A1 Feb. 15, 2007

(51) Int. Cl.
*G05F 3/24* (2006.01)

(52) U.S. Cl. ..... 323/313; 323/907; 527/543; 527/513

(58) Field of Classification Search ..... 323/312–316; 327/539–543, 513, 378, 309
See application file for complete search history.

(56) References Cited

U.S. PATENT DOCUMENTS

| | | | | |
|---|---|---|---|---|
| 5,936,392 | A * | 8/1999 | Taylor | 323/315 |
| 5,949,277 | A * | 9/1999 | Iravani | 327/541 |
| 5,955,874 | A * | 9/1999 | Zhou et al. | 323/315 |
| 6,107,866 | A * | 8/2000 | Migliavacca | 327/539 |
| 7,038,530 | B2 * | 5/2006 | Chou | 327/543 |

* cited by examiner

*Primary Examiner*—Rajnikant B. Patel
(74) *Attorney, Agent, or Firm*—Volpe and Koenig, P.C.

(57) ABSTRACT

A bandgap reference voltage circuit is provided, in which an additional resistor as well as a transistor is utilized to prevent the source-drain voltage of a metal oxide semiconductor field effect transistor electrically connected to an output terminal of the bandgap reference voltage circuit from falling into the triode region. Through the provided bandgap reference voltage circuit, the temperature compensation effect is able to be normally executed, so as to supply a stable bandgap reference voltage.

13 Claims, 8 Drawing Sheets

BANDGAP REFERENCE VOLTAGE CIRCUIT

FIELD OF THE INVENTION

The present invention relates to a bandgap reference voltage circuit, and more particular to a bandgap reference voltage circuit with a perfect temperature compensation effect at a rising temperature.

BACKGROUND OF THE INVENTION

In the technical report entitled "A Low Supply Voltage High PSRR Voltage Reference in CMOS Process" by Khong-Meng Tham and Krishnaswamy Nagaraj, a conventional bandgap reference voltage circuit 10 is disclosed, as shown in FIG. 1(*a*). The bandgap reference voltage circuit 10 includes a first, a second and a third p-typed metal oxide semiconductor field effect transistors (MOSFETs) M1, M2 and M3, a first and a second pnp-typed bipolar junction transistors (BJTs) Q1 and Q2, and a first and a second resistors R1 and R2. In this case, the pn junction area ratio of the first pnp-typed bipolar junction transistor Q1 is equal to M multiplied by that of the second pnp-typed bipolar junction transistor Q2, in which M is an integer greater than 2, and the channel area ratio of the third p-typed metal oxide semiconductor field effect transistor M3 is equal to N multiplied by those of the first and the second p-typed metal oxide semiconductor field effect transistors M1 and M2, wherein the respective channel areas of the first and the second MOSFETs, M1 and M2 are the same so as to constitute a current mirror.

Through the simple algebra operation, the bandgap voltage VBG is presented as the following equation (1).

$$VBG=VBEQ2+N(R2/R1)1n\{M(N+1)\}VT \quad (1)$$

Because the characteristics that the base-emitter voltage of the second bipolar junction transistor Q2 would decrease with the rising temperature (about −2.2 mV/° C. at 25° C.) and that thermal voltage constant would increase with the rising temperature (+0.085 mV/° C.), thus a bandgap reference voltage VBG which is independent of temperature is achievable via selecting suitable values of the ratio of R2 and R1, M and N.

However, the disadvantage of the bandgap reference voltage circuit 10 shown in FIG. 1(*a*) is that the voltage VREG would decrease with the rising temperature while the bandgap reference voltage VBG still remains as a constant, which makes the source-drain voltage VSD of the third metal oxide semiconductor field effect transistor M3 decrease substantially. When the temperature reaches a specific value, the third metal oxide semiconductor field effect transistor M3 would be operated in a triode region, as shown in FIG. 1(*b*). This makes the drain current ID of the third metal oxide semiconductor field effect transistor M3 decrease instantly and the bandgap reference voltage VBG would substantially decrease with the rising temperature responding thereto, which leads to a failure situation on the temperature compensation effect, as shown in FIG. 1(*c*).

For overcoming the mentioned disadvantage of prior art above, a novel bandgap reference voltage circuit is provided in the present invention. The provided bandgap reference voltage circuit is capable of performing the temperature compensation effect normally so as to provide a stable bandgap reference voltage.

SUMMARY OF THIS INVENTION

The main aspect of the present invention is to provide a bandgap reference voltage circuit, in which the source-drain voltage of the metal oxide semiconductor field effect transistor which electrically connected to an output terminal of the bandgap reference voltage circuit falling into a triode region is prevented, so that the temperature compensation effect is able to be executed and thus the provide normally bandgap reference voltage is stable.

In accordance with the aspect of the present invention, the bandgap reference voltage circuit includes a first metal oxide semiconductor field effect transistor having a first source electrically connected to a relatively high voltage and a first gate electrically connected to a first drain thereof, a second metal oxide semiconductor field effect transistor having a second source electrically connected to the relatively high voltage, a second gate electrically connected to the first gate and a second drain, a third metal oxide semiconductor field effect transistor having a third gate electrically connected to the second gate, a third source and a third drain, a first resistor having a first terminal electrically connected to the relatively high voltage and a second terminal electrically connected to the third source, a second resistor having a third terminal electrically connected to the first drain and having a fourth terminal, a first bipolar junction transistor having a first emitter electrically connected to the fourth terminal and having a first base and a first collector mutually and electrically connected to a relatively low voltage, a second bipolar junction transistor having a second emitter electrically connected to the second drain and having a second base and a second collector mutually and electrically connected to the relatively low voltage, and a third resistor having a fifth terminal electrically connected to the second emitter and a sixth terminal electrically connected to the third drain to supply a bandgap reference voltage.

Preferably, the third metal oxide semiconductor field effect transistor has a drain current to be decreased by the first resistor in response to a rising temperature, so as to keep a voltage between the third source and the third drain higher than a specific value.

Preferably, the first, second and third metal oxide semiconductor field effect transistors are p-typed metal oxide semiconductor field effect transistors (PMOSFETs).

Preferably, the first metal oxide semiconductor field effect transistor has a first channel length ratio, the second metal oxide semiconductor field effect transistor has a second channel length ratio, and the third metal oxide semiconductor field effect transistor has a third channel length ratio in which the first channel length ratio is equal to the second channel length ratio, and the third channel length ratio is equal to N multiplied by the first channel length ratio, in which N is an integer greater than 1.

Preferably, the first and second bipolar junction transistors are pnp-typed bipolar junction transistors.

Preferably, the bandgap reference voltage circuit further includes a pn junction area ratio M of the first bipolar junction transistor to the second bipolar junction transistor, and M is an integer greater than 1.

Preferably, the relatively low voltage is provided by grounding.

In accordance with another aspect of the present invention, a bandgap reference voltage circuit is provided. The provided bandgap reference circuit includes a first metal oxide semiconductor field effect transistor having a first source electrically connected to a relatively high voltage and a first gate electrically connected to a first drain thereof, a second metal oxide semiconductor field effect transistor having a second source electrically connected to the relatively high voltage, a second gate electrically connected to the first gate and a second drain, a third metal oxide semiconductor field effect transistor having a third gate electrically connected to the second gate and having a third drain, a first bipolar junction transistor having a first emitter electrically connected to the first drain and having a first base electrically connected to a first collector thereof, a second bipolar junction transistor having a second emitter electrically connected to the second drain and having a second base electrically connected to a second collector thereof, a first resistor having a first terminal electrically connected to the first collector and having a second terminal, a third bipolar junction transistor having a third emitter electrically connected to the second terminal and having a third base and a third collector mutually and electrically connected to a relatively low voltage, a fourth bipolar junction transistor having a fourth emitter electrically connected to the second collector and having a fourth base and a fourth collector mutually and electrically connected to the relatively low voltage, and a second resistor having a third terminal electrically connected to the fourth emitter and a fourth terminal electrically connected to the third drain to supply a bandgap reference voltage.

Preferably, the relatively high voltage is increased by the first and second bipolar junction transistors in response to a rising temperature, so as to keep a voltage between the third source and the third drain higher than a specific value.

Preferably, the first, second and third metal oxide semiconductor field effect transistors are p-typed metal oxide semiconductor field effect transistors (PMOSFETs).

Preferably, the first metal oxide semiconductor field effect transistor has a first channel length ratio, the second metal oxide semiconductor field effect transistor has a second channel length ratio, and the third metal oxide semiconductor field effect transistor has a third channel length ratio in which the first channel length ratio is equal to the second channel length ratio, and the third channel length ratio is equal to N multiplied by the first channel length ratio, in which N is an integer greater than 1.

Preferably, the first and second bipolar junction transistors are pnp-typed bipolar junction transistors.

Preferably, the third and fourth bipolar junction transistors are pnp-typed bipolar junction transistors.

Preferably, the bandgap reference voltage circuit further includes a pn junction area ratio M of the third bipolar junction transistor to the fourth bipolar junction transistor, and M is an integer greater than 1.

Preferably, the relatively low voltage is provided by grounding.

The above contents and advantages of the present invention will become more readily apparent to those ordinarily skilled in the art after reviewing the following detailed descriptions and accompanying drawings, in which:

BRIEF DESCRIPTION OF THE DRAWINGS

FIG. 1(*b*) is a diagram showing the relationship between the third drain current and the source-drain of the bandgap reference voltage circuit shown in FIG. 1(*a*);

FIG. 1(*c*) is a diagram showing the dependency of bandgap reference voltage VBG on the temperature for the bandgap reference voltage circuit shown in FIG. 1(*a*);

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only, it is not intended to be exhaustive or to be limited to the precise form disclosed.

Figure 1A:
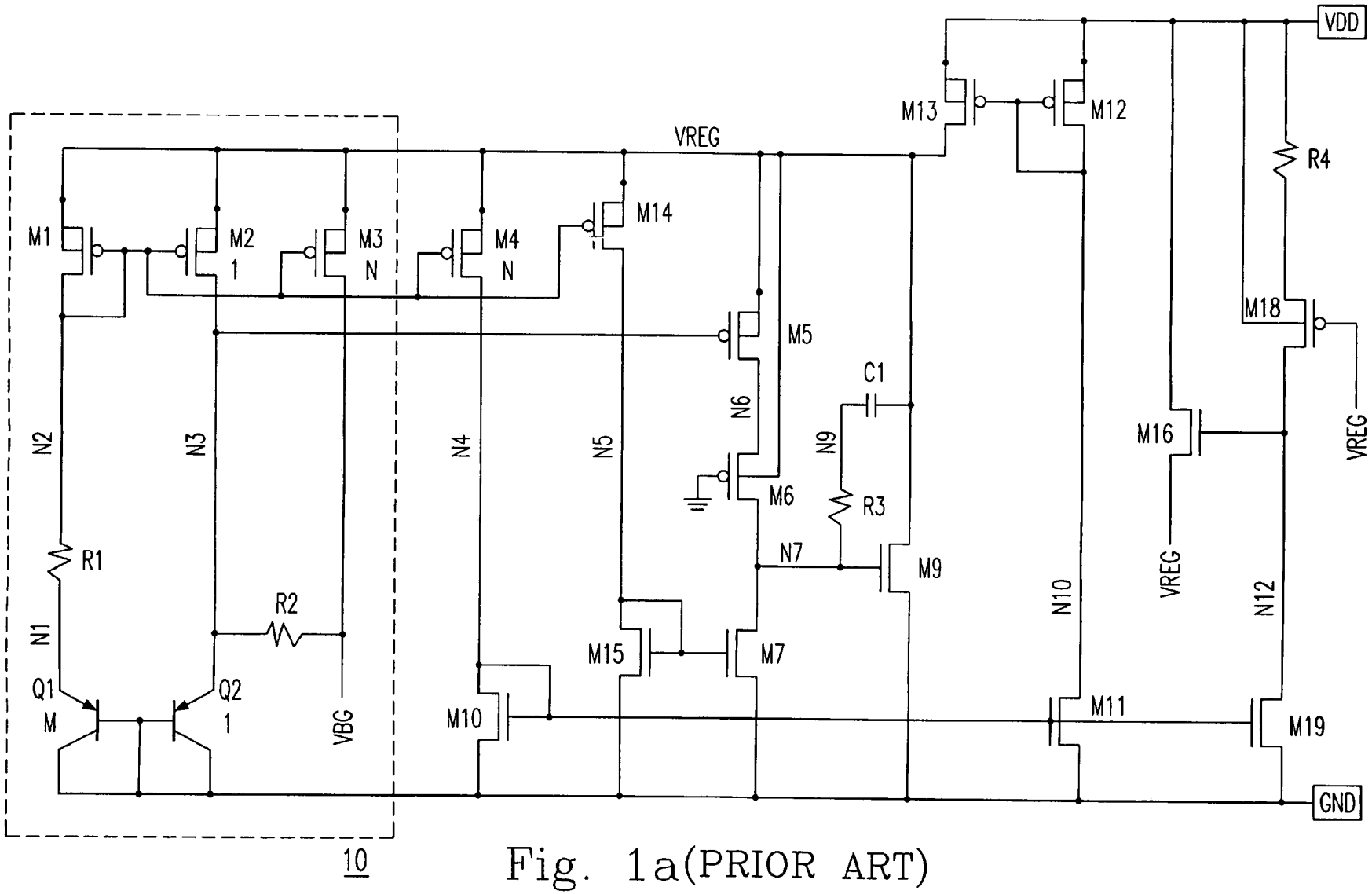
Fig. 1a(PRIOR ART)
FIG. 1(*a*) is a diagram schematically illustrating the conventional bandgap reference voltage circuit according to the prior art.
Figure 1B:
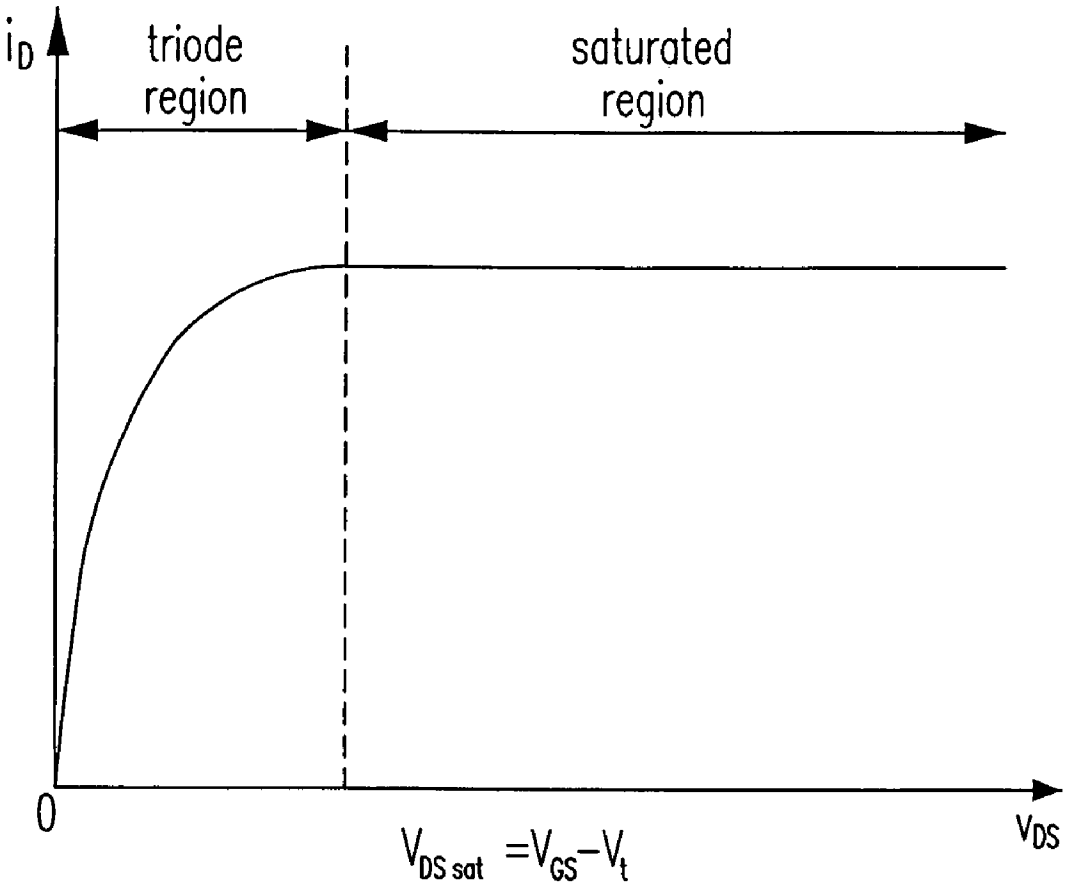
Fig. 1b(PRIOR ART)
Figure 1C:
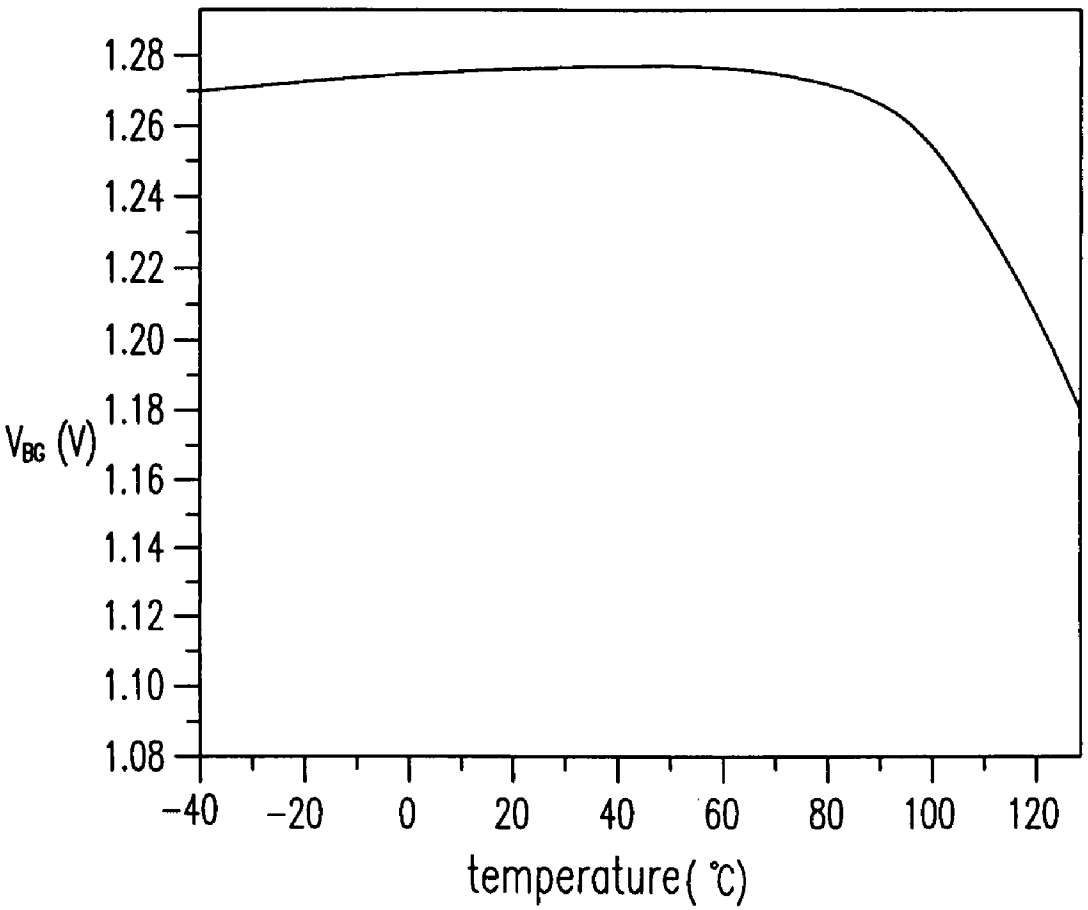
Fig. 1c(PRIOR ART)
Figure 2:
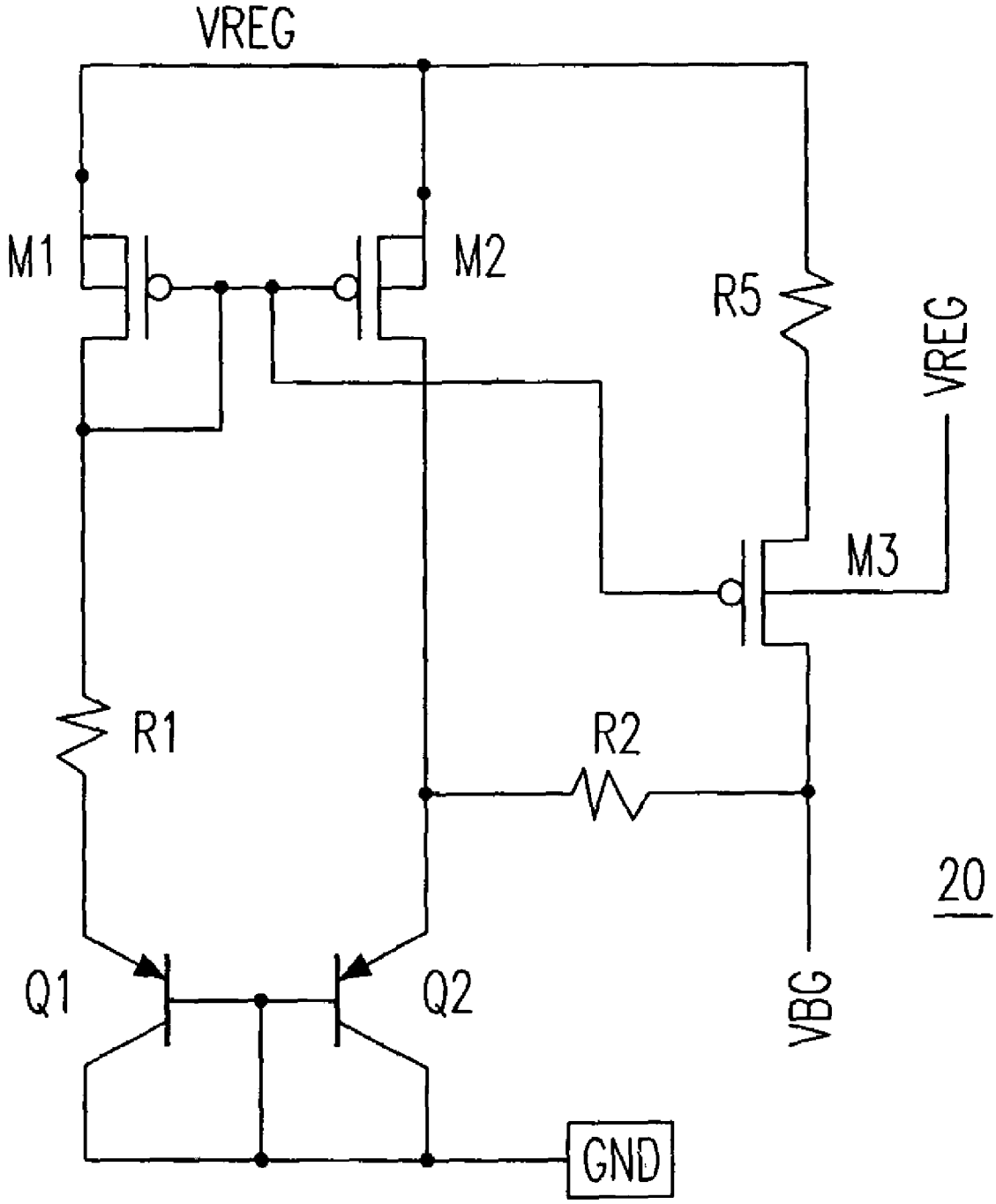
FIG. 2 is a diagram schematically showing a bandgap reference voltage circuit according to a first preferred embodiment of the present invention.

Please refer to FIG. 2, which schematically shows a bandgap reference voltage circuit according to a first preferred embodiment of the present invention. As shown in FIG. 2, the bandgap reference voltage circuit 20 includes three p-typed metal oxide semiconductor field effect transistors M1, M2 and M3, three resistors R1, R2 and R5, and two pnp-typed bipolar junction transistor Q1 and Q2.

The first metal oxide semiconductor field effect transistor M1 has a first source electrically connected to a relatively high voltage VREG, and a first gate electrically connected to a first drain thereof. The second metal oxide semiconductor field effect transistor M2 has a second source electrically connected to the relatively high voltage VREG, a second gate electrically connected to the first gate of the first metal oxide semiconductor field effect transistor M1 and a second drain. The third metal oxide semiconductor field effect transistor M3 has a third gate electrically connected to the second gate, a third source and a third drain. The first resistor R1 having a first terminal electrically connected to the relatively high voltage VREG and a second terminal electrically connected to the third source of the third metal oxide semiconductor field effect transistor M3. The second resistor R2 has a third terminal electrically connected to the first drain and has a fourth terminal. The first bipolar junction transistor Q1 has a first emitter electrically connected to the fourth terminal and has a first base and a first collector mutually and electrically connected to a relatively low voltage provided by grounding GND. The second bipolar junction transistor Q2 has a second emitter electrically connected to the second drain and has a second base and a second collector mutually and electrically connected to the relatively low voltage provided by grounding GND. Moreover, the third resistor R5 has a fifth terminal electrically connected to the second emitter and a sixth terminal electrically connected to the third drain, so as to supply a bandgap reference voltage VBG.

It is worthy to note that the first metal oxide semiconductor field effect transistor M1 has a first channel length ratio, which is equal to the channel length ratio of the second metal oxide semiconductor field effect transistor M2, and the third metal oxide semiconductor field effect transistor has a third channel length ratio which is equal to N multiplied by the first channel length ratio, in which N is an integer greater than 1. In addition, the pn junction area of the first bipolar junction transistor Q1 is equal to M multiplied by that of the second bipolar junction transistor Q2, wherein M is an integer greater than 1.

In comparison with the conventional bandgap reference voltage circuit, the main feature of the present invention is that the third resistor R5 is electrically connected between the source of the third metal oxide semiconductor field effect transistor M3 and the relatively high voltage VREG, so that the drain current of the third metal oxide semiconductor field effect transistor M3 is reduced. Respondingly, the node voltage between the second resistor R2 and the drain of the third metal oxide semiconductor field effect transistor M3 would decrease, and the source-drain voltage of the third metal oxide semiconductor field effect transistor M3 would be greater than a specific value, so as to prevent the third metal oxide semiconductor field effect transistor M3 from being operated in the triode region, and thus the failure situation of the third metal oxide semiconductor field effect transistor M3 caused by a rising temperature is overcome.

Figure 3:
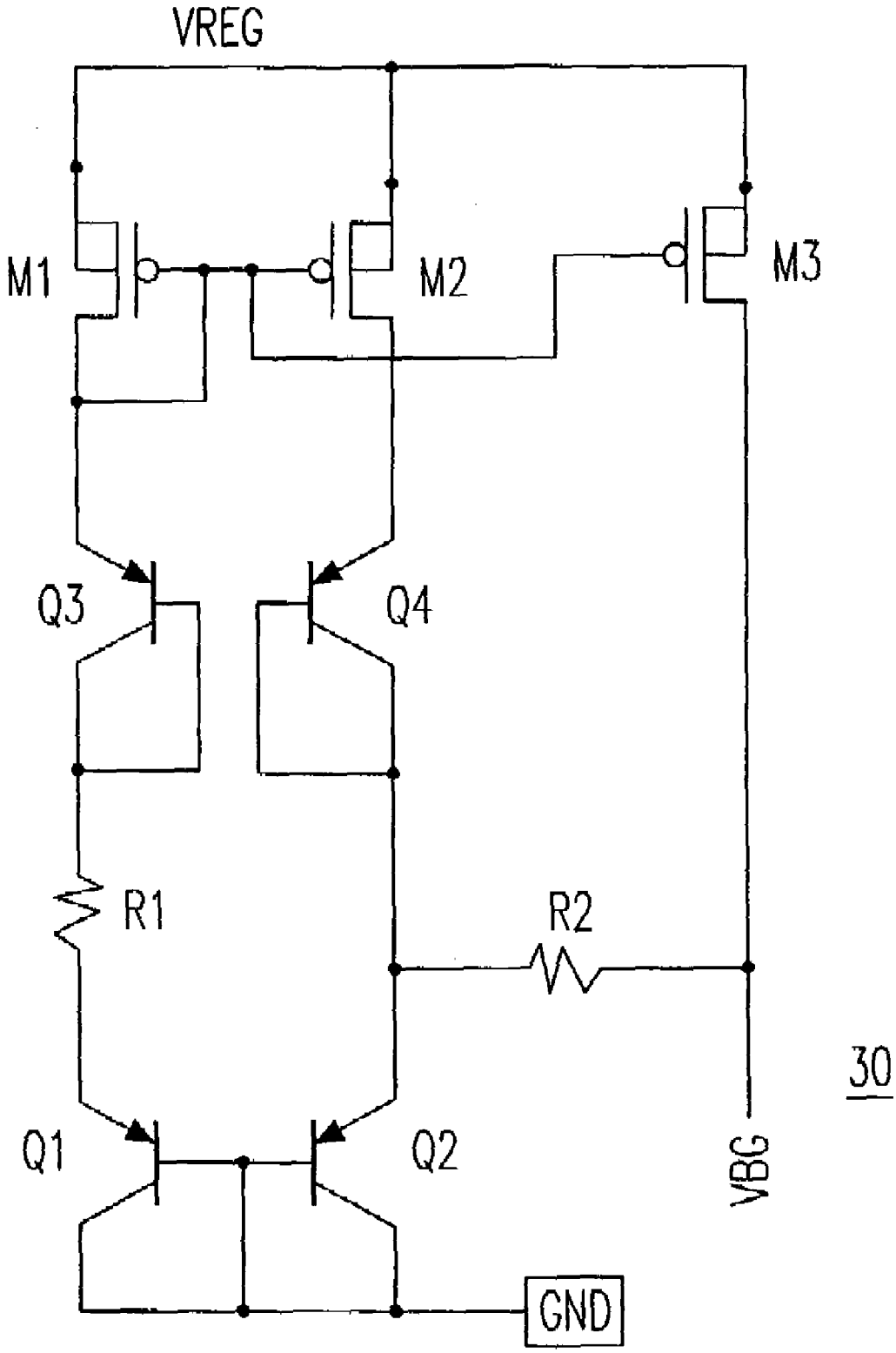
FIG. 3 is a diagram schematically showing a bandgap reference voltage circuit according to a second preferred embodiment of the present invention.

Please refer to FIG. 3, which shows the bandgap reference voltage circuit according to a second preferred embodiment of the present invention. In this embodiment, a pair of pnp-typed bipolar junction transistors Q3 and Q4 are arranged instead of the resistor R5 in the first embodiment. The respective bases of the pnp-typed bipolar junction transistors Q3 and Q4 are electrically connected to their collectors.

In this case, the relatively high voltage VREG is increased by an extra voltage, i.e. the base-emitter voltage of the third (or fourth) bipolar junction transistor Q3 (or Q4), thereby the decreasing value of the relatively high voltage in response to a rising temperature is compensated, so as to prevent the third metal oxide semiconductor field effect transistor M3 from being operated in the triode region, and thus the failure situation of the third metal oxide semiconductor field effect transistor M3 caused by a rising temperature is overcome.

Figure 4:
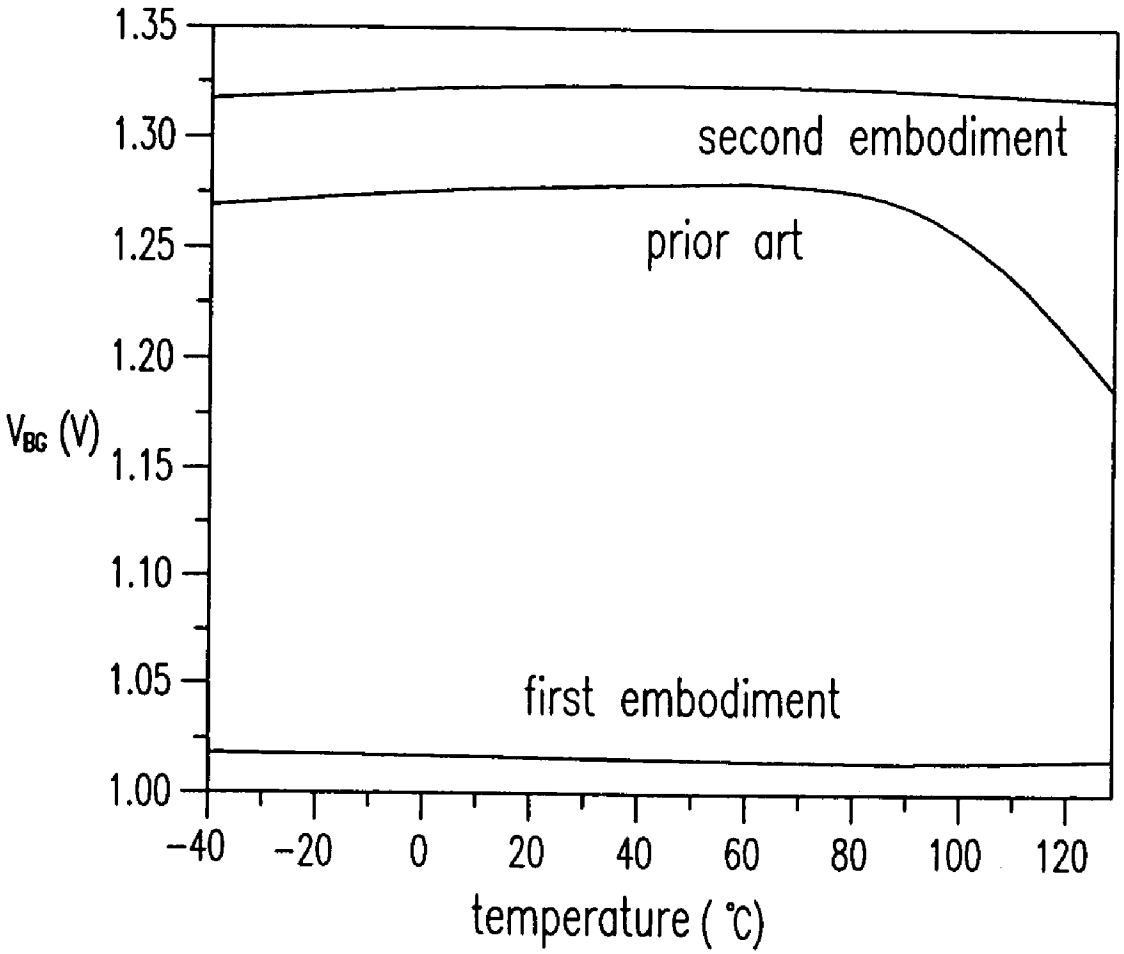
FIG. 4 is a diagram showing the dependencies of the respective bandgap reference voltages VBG on the temperature for the two preferred embodiments of the present invention in comparison with that of the conventional one.

Please refer to FIG. 4, which shows the dependencies of the respective bandgap reference voltages VBG on the temperature for the two preferred embodiments of the present invention in comparison with that of the conventional one. As shown in FIG. 4, it proves that the good electric characteristic of bandgap reference voltage circuit is achievable by means of the first and the second preferred embodiments as mentioned, and the temperature compensation effect is also sufficiently improved.

Figure 5:
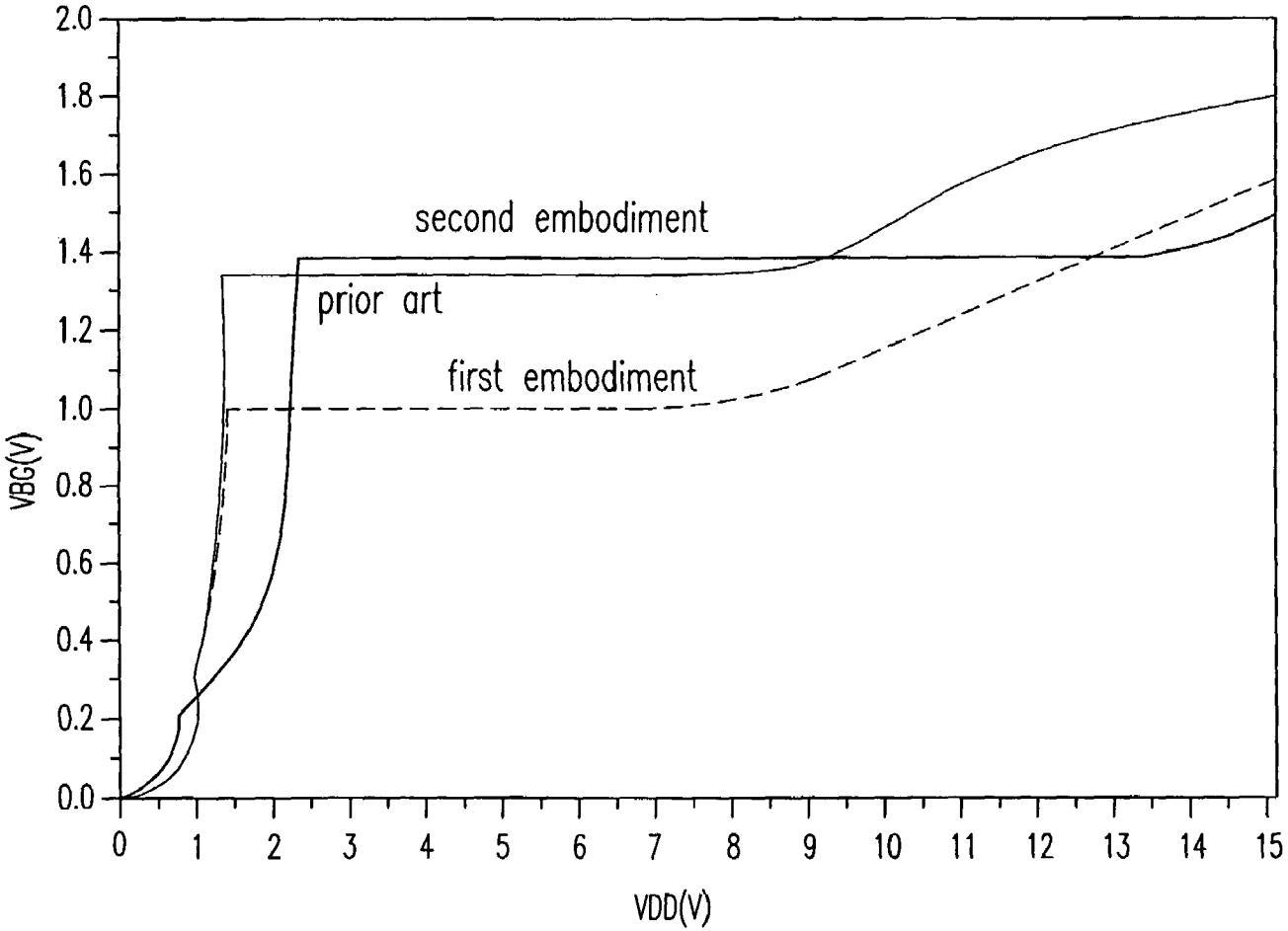
FIG. 5 is a diagram showing the dependencies of the respective bandgap reference voltages VBG on the applied voltage VDD for the two preferred embodiments of the present invention in comparison with that of the conventional one.

Please refer to FIG. 5, which shows the dependencies of the respective bandgap reference voltages VBG on the applied voltage VDD for the two preferred embodiments of the present invention in comparison with that of the conventional one. As shown in FIG. 5, the respective lowest threshold voltages of the first and the second embodiments are both below 3V, in which the application of the first preferred embodiment is broader since the threshold voltage thereof is lower.

Figure 6:
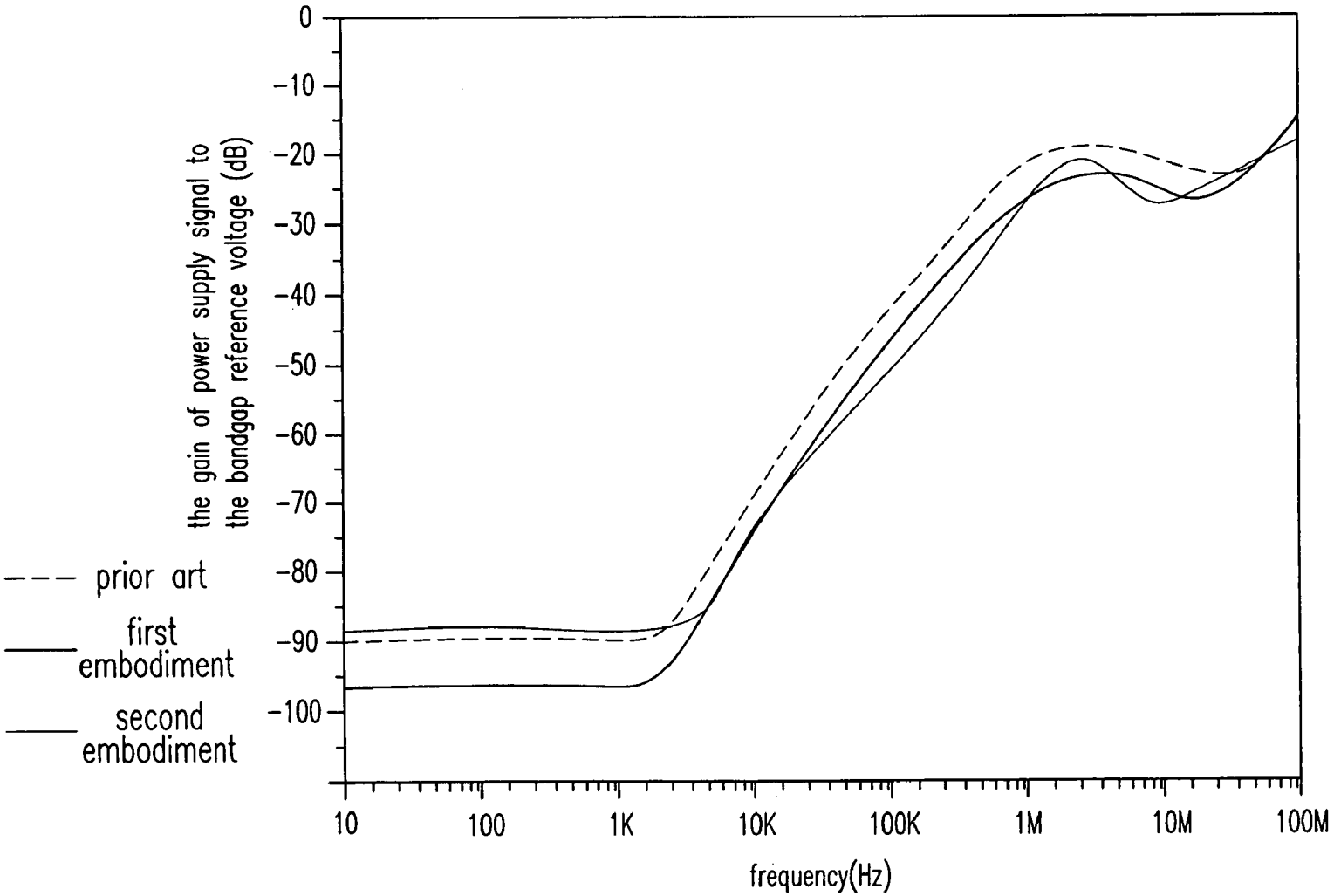
FIG. 6 is a diagram showing the dependencies of the gain of power supply signal to the bandgap reference voltage for the two preferred embodiments of the present invention in comparison with that of the conventional one.

Please refer to FIG. 6, which shows the dependencies of the gain of power supply signal to the bandgap reference voltage for the two preferred embodiments of the present invention in comparison with that of the conventional one. As shown in FIG. 6, the gain of power supply signal to the bandgap reference voltage is about −90 dB regardless of the first or second preferred embodiment, even about −25 dB when the frequency reached at 1 MHz.

As the above-mentioned, the triode-region operation as well as the failure situation of temperature compensation effect caused by the decreasing source-drain voltage of the metal oxide semiconductor field effect transistor in response to a rising temperature is overcome by the bandgap reference voltage circuit of the present invention. In addition, the bandgap reference voltage circuit has a relatively low threshold voltage, a relatively high power supply rejection ratio and a simplified structure, so that the present invention not only bears a novelty and a progressiveness, but also bears the utility.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bandgap reference voltage circuit, comprising:

a first metal oxide semiconductor field effect transistor having a first source electrically connected to a relatively high voltage, and a first gate electrically connected to a first drain thereof;

a second metal oxide semiconductor field effect transistor having a second source electrically connected to said relatively high voltage, a second gate electrically connected to said first gate and a second drain;

a third metal oxide semiconductor field effect transistor having a third gate electrically connected to said second gate, a third source and a third drain;

a first resistor having a first terminal electrically connected to said relatively high voltage and a second terminal electrically connected to said third source;

a second resistor having a third terminal electrically connected to said first drain and having a fourth terminal;

a first bipolar junction transistor having a first emitter electrically connected to said fourth terminal and having a first base and a first collector mutually and electrically connected to a relatively low voltage;

a second bipolar junction transistor having a second emitter electrically connected to said second drain and having a second base and a second collector mutually and electrically connected to said relatively low voltage; and a third resistor having a fifth terminal electrically connected to said second emitter and a sixth terminal electrically connected to said third drain to supply a bandgap reference voltage, wherein said third metal oxide semiconductor field effect transistor has a drain current to be decreased by said first resistor in response to a rising temperature, so as to keep a voltage between said third source and said third drain higher than a specific value.

2. The bandgap reference voltage circuit as claimed in claim 1, wherein said first, second and third metal oxide semiconductor field effect transistors are p-typed metal oxide semiconductor field effect transistors (PMOSFETs).

3. The bandgap reference voltage circuit as claimed in claim 1, wherein said first metal oxide semiconductor field effect transistor has a first channel length ratio, said second metal oxide semiconductor field effect transistor has a second channel length ratio, and said third metal oxide semiconductor field effect transistor has a third channel length ratio in which said first channel length ratio is equal to said second channel length ratio, and said third channel length ratio is equal to N multiplied by said first channel length ratio, in which said N is an integer greater than 1.

4. The bandgap reference voltage circuit as claimed in claim 1, wherein said first and second bipolar junction transistors are pnp-typed bipolar junction transistors.

5. The bandgap reference voltage circuit as claimed in claim 1, further comprising a pn junction area ratio M of said first bipolar junction transistor to said second bipolar junction transistor, wherein said M is an integer greater than 1.

6. The bandgap reference voltage circuit as claimed in claim 1, wherein said relatively low voltage is provided by grounding.

7. A bandgap reference voltage circuit, comprising:

a first metal oxide semiconductor field effect transistor having a first source electrically connected to a relatively high voltage, and a first gate electrically connected to a first drain thereof;

a second metal oxide semiconductor field effect transistor having a second source electrically connected to said relatively high voltage, a second gate electrically connected to said first gate and a second drain;

a third metal oxide semiconductor field effect transistor having a third gate electrically connected to said second gate and having a third drain;

a first bipolar junction transistor having a first emitter electrically connected to said first drain and having a first base electrically connected to a first collector thereof;

a second bipolar junction transistor having a second emitter electrically connected to said second drain and having a second base electrically connected to a second collector thereof;

a first resistor having a first terminal electrically connected to said first collector and having a second terminal;

a third bipolar junction transistor having a third emitter electrically connected to said second terminal and having a third base and a third collector mutually and electrically connected to a relatively low voltage;

a fourth bipolar junction transistor having a fourth emitter electrically connected to said second collector and having a fourth base and a fourth collector mutually and electrically connected to said relatively low voltage; and a second resistor having a third terminal electrically connected to said fourth emitter and a fourth terminal electrically connected to said third drain to supply a bandgap reference voltage, wherein said relatively high voltage is increased by said first and second bipolar junction transistors in response to a rising temperature, so as to keep a voltage between said third source and said third drain higher than a specific value.

8. The bandgap reference voltage circuit as claimed in claim 7, wherein said first, second and third metal oxide semiconductor field effect transistors are p-typed metal oxide semiconductor field effect transistors (PMOSFETs).

9. The bandgap reference voltage circuit as claimed in claim 7, wherein said first metal oxide semiconductor field effect transistor has a first channel length ratio, said second metal oxide semiconductor field effect transistor has a second channel length ratio, and said third metal oxide semiconductor field effect transistor has a third channel length ratio in which said first channel length ratio is equal to said second channel length ratio, and said third channel length ratio is equal to N multiplied by said first channel length ratio, in which said N is an integer greater than 1.

10. The bandgap reference voltage circuit as claimed in claim 7, wherein said first and second bipolar junction transistors are pnp-typed bipolar junction transistors.

11. The bandgap reference voltage circuit as claimed in claim 7, wherein said third and fourth bipolar junction transistors are pnp-typed bipolar junction transistors.

12. The bandgap reference voltage circuit as claimed in claim 7, further comprising a pn junction area ratio M of said third bipolar junction transistor to said fourth bipolar junction transistor, wherein said M is an integer greater than 1.

13. The bandgap reference voltage circuit as claimed in claim 7, wherein said relatively low voltage is provided by grounding.

* * * * *